US010161601B1

(12) United States Patent
Chen

(10) Patent No.: US 10,161,601 B1
(45) Date of Patent: Dec. 25, 2018

(54) COLLAPSIBLE DECORATIVE LAMP

(71) Applicant: Zhu Hai Fu Yun Lighting Industrial Co., Ltd., Zhuhai (CN)

(72) Inventor: Su-Hua Chen, New Taipei (TW)

(73) Assignee: ZHU HAI FU YUN LIGHTING INDUSTRIAL CO., LTD., Zhuhai (CN)

( * ) Notice: Subject to any disclaimer, the term of this patent is extended or adjusted under 35 U.S.C. 154(b) by 0 days.

(21) Appl. No.: 15/900,027

(22) Filed: Feb. 20, 2018

(51) Int. Cl.

| | |
|---|---|
| ***F21V 1/06*** | (2006.01) |
| ***F21V 3/02*** | (2006.01) |
| ***F21V 17/00*** | (2006.01) |
| ***F21V 21/14*** | (2006.01) |
| ***F21V 21/08*** | (2006.01) |
| ***F21S 8/06*** | (2006.01) |
| ***F21S 9/02*** | (2006.01) |
| ***F21V 17/02*** | (2006.01) |
| *F21Y 115/10* | (2016.01) |

(52) U.S. Cl.
CPC ..... *F21V 17/007* (2013.01); *F21S 8/063* (2013.01); *F21S 9/02* (2013.01); *F21V 3/02* (2013.01); *F21V 17/02* (2013.01); *F21V 21/08* (2013.01); *F21V 21/14* (2013.01); *F21Y 2115/10* (2016.08)

(58) Field of Classification Search
CPC ..... F21V 17/007; F21V 17/02; F21V 3/02; F21V 21/14; F21V 21/08; F21S 9/02; F21S 8/063; F21Y 2115/10
See application file for complete search history.

(56) References Cited

U.S. PATENT DOCUMENTS

| | | | | |
|---|---|---|---|---|
| 5,629,057 A * | 5/1997 | Wang | B44C 5/00 | 362/122 |
| 6,135,617 A * | 10/2000 | Lai | F21V 17/007 | 362/249.09 |
| 6,386,734 B1 * | 5/2002 | Huang | A47G 33/06 | 362/249.01 |
| 6,401,404 B1 * | 6/2002 | Fillipp | B44C 5/00 | 362/249.04 |
| 6,598,990 B2 * | 7/2003 | Li | A45B 3/04 | 362/102 |

* cited by examiner

*Primary Examiner* — Peggy Neils
(74) *Attorney, Agent, or Firm* — Muncy, Geissler, Olds & Lowe, P.C.

(57) ABSTRACT

A collapsible decorative lamp including a collapsible frame and a plurality of light strips is disclosed. The collapsible frame includes a plurality of rib stands, a top folding band, a bottom folding band and a plurality of light slots. Each of the plurality of rib stands is shaped as a curved strip. The top folding band includes a plurality of top pivot sheets. The plurality of top pivot sheets are pivotally connected to one another. The plurality of top pivot sheets are rotatable such that the top folding band can appear as a long strip structure or a ring structure. The bottom folding band includes a plurality of bottom pivot sheets. The plurality of bottom pivot sheets are pivotally connected to one another and the plurality of bottom pivot sheets are rotatable such that the bottom folding band appears as a long strip structure or a ring structure.

12 Claims, 15 Drawing Sheets

COLLAPSIBLE DECORATIVE LAMP

BACKGROUND OF THE INVENTION

1. Field of the Invention

The present invention relates to a collapsible decorative lamp; more particularly, the present invention relates to a collapsible decorative lamp which can mitigate the problems of lamp storage and packing and reduce the cost of the transport process.

2. Description of the Related Art

A decorative lamp is a lamp with a special lampshade and lighting effect to provide a comfortable atmosphere, and such decorative lamps are usually applied in bars, hotels or restaurants for decoration. According to different requirements, the decorative lamp may be designed to be different shapes, such as a sphere. Generally, when the decorative lamp leaves the factory, the assembly of the decorative lamp is already completed; thus, the user can buy the decorative lamp and easily install the decorative lamp by using screws or other fitting accessories. However, the decorative lamp of the prior art has three problems: 1. Because the assembly of the decorative lamp is completed at the factory, the decorative lamp has a large volume and occupies much storage and transportation space. 2. The decorative lamp is not a solid item, the material of each part may be different, and the outer case may be damaged by collisions; thus, a large amount of buffer material must be added in the package box of the decorative lamp to prevent damage to the decorative lamp, so the difficulty and cost of transport are increased. 3. Most of the space in the package box of the decorative lamp is occupied by the buffer, and the accessories of the decorative lamp must be packaged in a separate box, so the cost of transport and packaging is increased.

Therefore, there is a need to provide a new decorative lamp that can mitigate the problems of lamp storage and packing and reduce the cost of the transport process.

SUMMARY OF THE INVENTION

The object of the present invention is to provide a collapsible decorative lamp that can mitigate the problems of lamp storage and packing and reduce the cost of the transport process.

To achieve the abovementioned object, the collapsible decorative lamp of the present invention includes a collapsible frame and a plurality of light strips. The collapsible frame includes a plurality of rib stands, a top folding band, a bottom folding band and a plurality of light slots. Each of the plurality of rib stands is shaped as a curved strip. The top folding band includes a plurality of top pivot sheets. The plurality of top pivot sheets are pivotally connected to one another. The plurality of top pivot sheets are rotatable such that the top folding band appears as a long strip structure or a ring structure. The bottom folding band includes a plurality of bottom pivot sheets. The plurality of bottom pivot sheets are pivotally connected to one another and the plurality of bottom pivot sheets are rotatable such that the bottom folding band appears as a long strip structure or a ring structure. The plurality of light slots are respectively located on the plurality of rib stands. The plurality of light strips are respectively located on the plurality of light slots. When the top folding band appears as the long strip structure and the bottom folding band appears as the long strip structure, the plurality of rib stands are close to one another. When the top folding band appears as the ring structure and the bottom folding band appears as the ring structure, the plurality of rib stands are away from one another.

According to one embodiment of the present invention, the collapsible decorative lamp further includes a top plate, and the top plate is connected to one of the top pivot sheets of the top folding band. When the top folding band appears as the ring structure, the ring structure of the top folding band surrounds the top plate.

According to one embodiment of the present invention, the collapsible decorative lamp further includes a bottom plate, and the bottom plate is connected to one of the bottom pivot sheets of the bottom folding band. When the bottom folding band appears as the ring structure, the ring structure of the bottom folding band surrounds the bottom plate.

According to one embodiment of the present invention, the collapsible decorative lamp further includes a plurality of translucent units, and the plurality of translucent units respectively cover the plurality of light strips.

According to one embodiment of the present invention, the top pivot sheet further includes a top pivot sheet hole and the top pivot sheet hole links to the light slot.

According to one embodiment of the present invention, when the ring structure of the top folding band surrounds the top plate, the top folding band and the top plate form a top containing area, and the top containing area is used for containing the power unit.

According to one embodiment of the present invention, the collapsible decorative lamp further includes an upper cover and a lower cover. The upper cover is located above the ring structure of the top folding band, and the lower cover is located under the ring structure of the top folding band.

According to one embodiment of the present invention, the upper cover includes a plurality of upper cover grooves, and the lower cover includes a plurality of lower cover grooves. The plurality of upper cover groove, the plurality of lower cover grooves and the plurality of rib stands are combined with one another.

According to one embodiment of the present invention, the collapsible decorative lamp further includes a hanging ring. The top plate further includes a top plate hole. The upper cover further includes an upper cover hole. The lower cover further includes a column. The column passes through the upper cover hole and the top plate hole such that the lower cover and the upper cover are combined with each other.

According to one embodiment of the present invention, the top plate further includes a top plate hole. The upper cover further includes an upper cover hole. The lower cover further includes a lower cover hole. A position of the top plate hole, a position of the upper cover hole and a position of the lower cover hole are corresponded to one another.

According to one embodiment of the present invention, the collapsible decorative lamp further includes a motor system, and the motor system includes a shaft and a rotating motor. A containing space is formed between the upper cover and the lower cover. The rotating motor is located in the containing space, and the shaft passes through the upper cover hole and the top plate hole.

According to one embodiment of the present invention, each of the plurality of top pivot sheets further includes a top fastener. The top fastener is fastened to the end of the rib stand. Each of the plurality of bottom pivot sheets further includes a bottom fastener. The bottom fastener is fastened to the other end of the rib stand.

According to one embodiment of the present invention, the top pivot sheet and the end of the rib stand are integrated, and the bottom pivot sheet and the other end of the rib stand are integrated.

DETAILED DESCRIPTION OF THE PREFERRED EMBODIMENT

Figure 1:
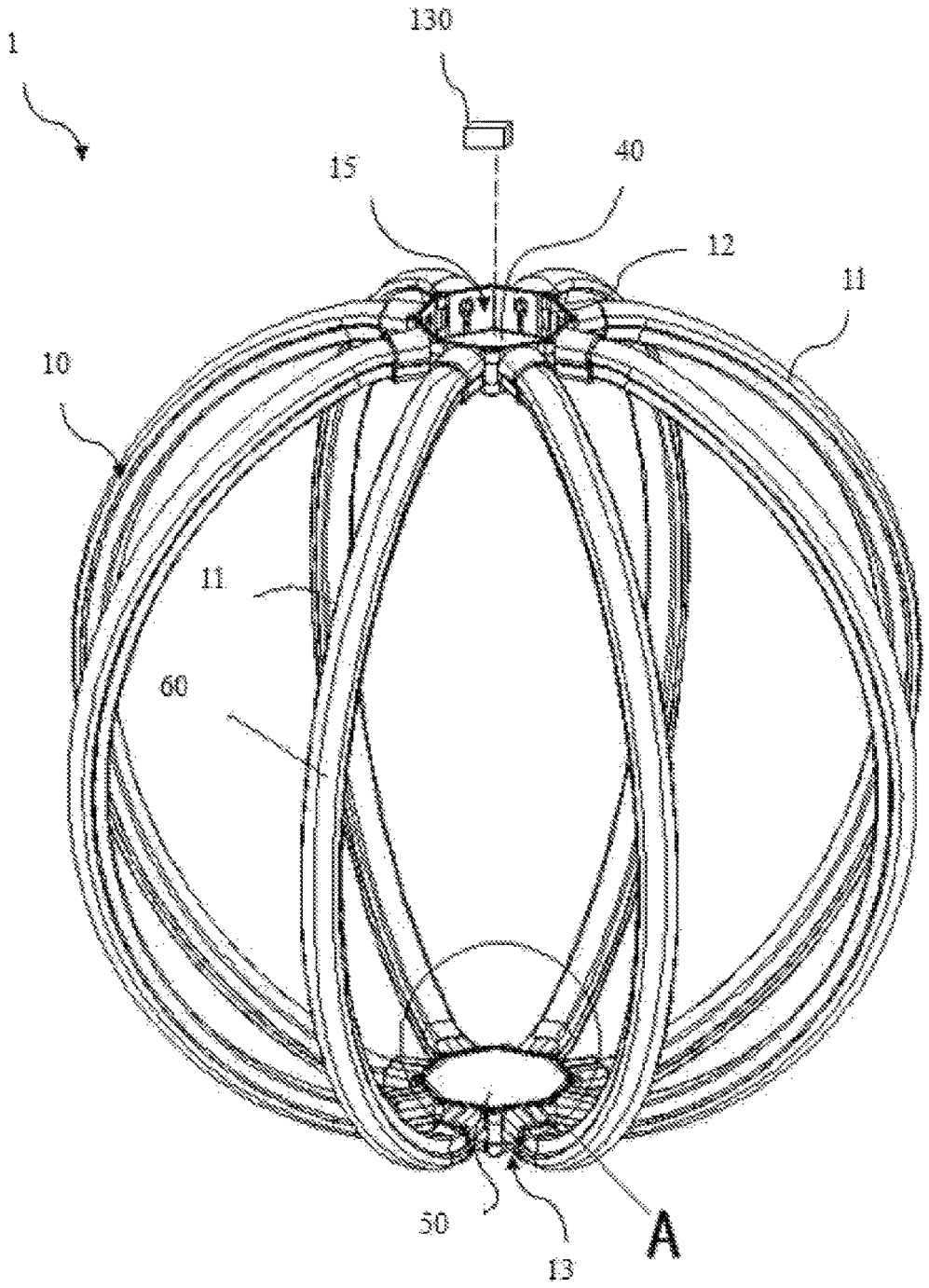
FIG. 1 illustrates a schematic drawing of a first embodiment of the collapsible decorative lamp of the present invention in the opened state.
Figure 2:
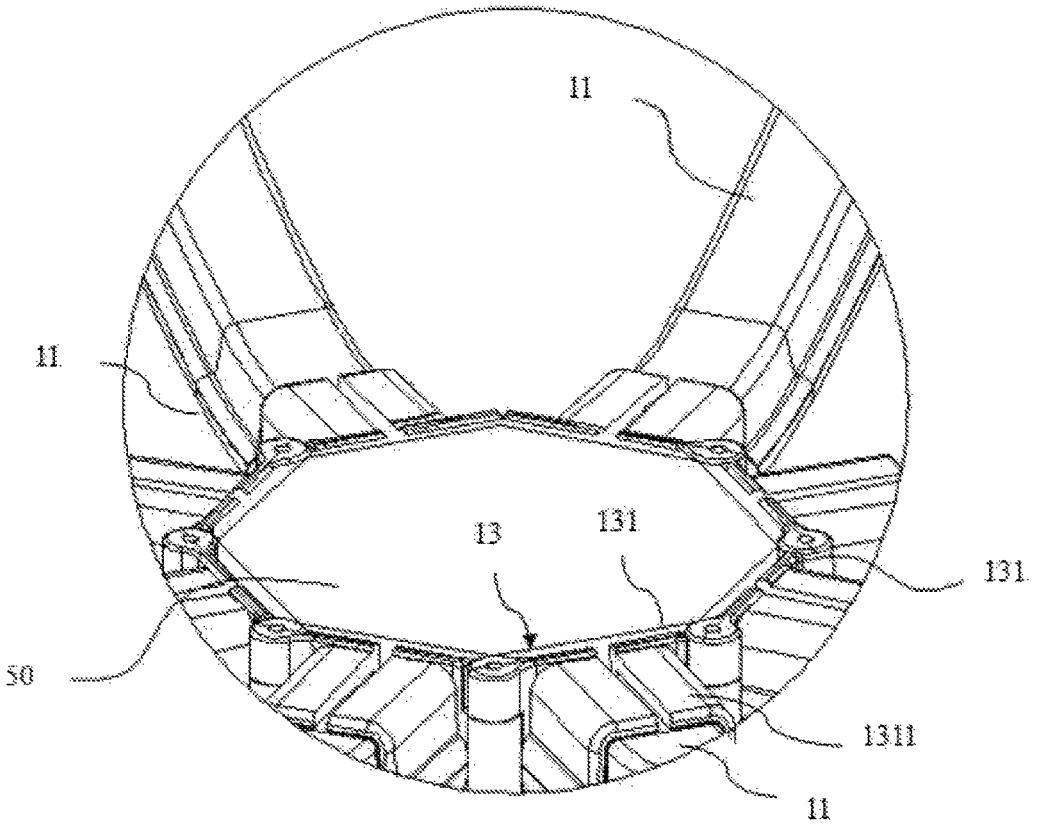
FIG. 2 illustrates a close-up drawing of the part indicated by A in FIG. 1.
Figure 3:
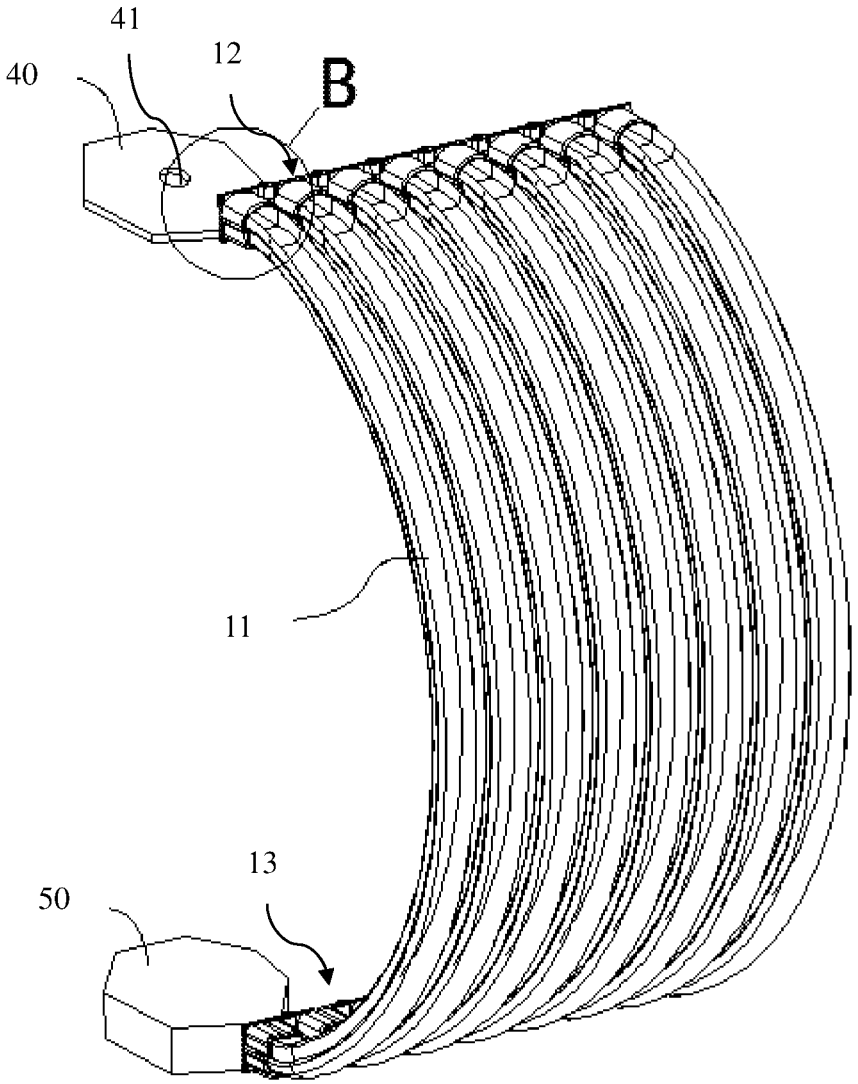
FIG. 3 illustrates a schematic drawing of the first embodiment of the collapsible decorative lamp of the present invention in the closed state.
Figure 4:
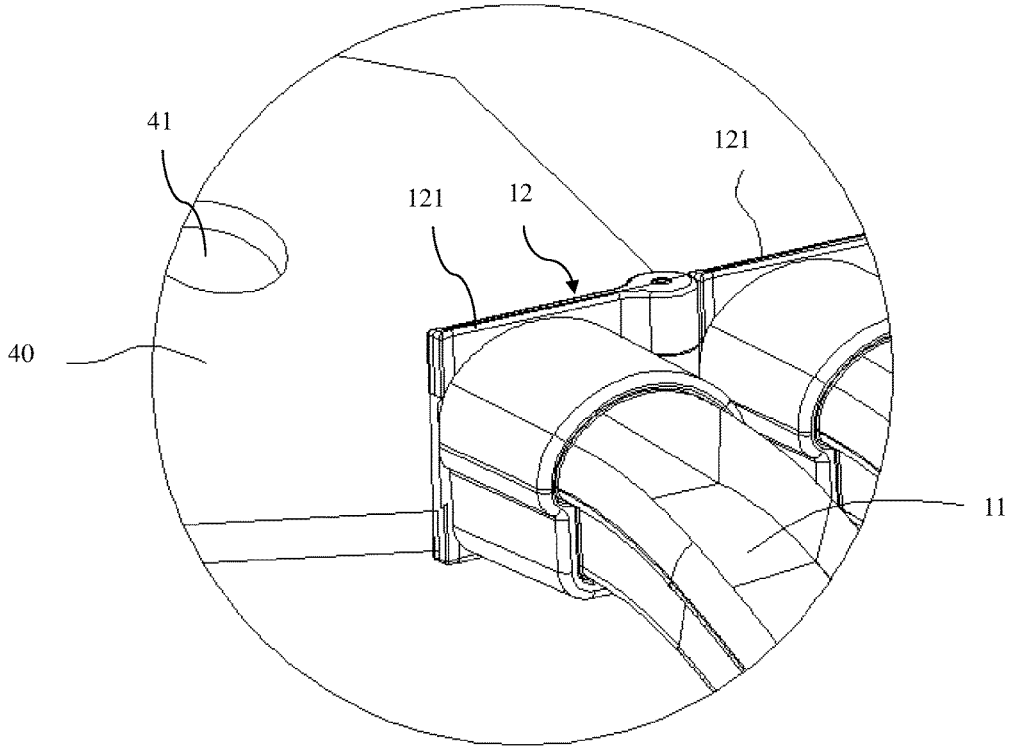
FIG. 4 illustrates a close-up drawing of the part indicated by B in FIG. 3.
Figure 5:
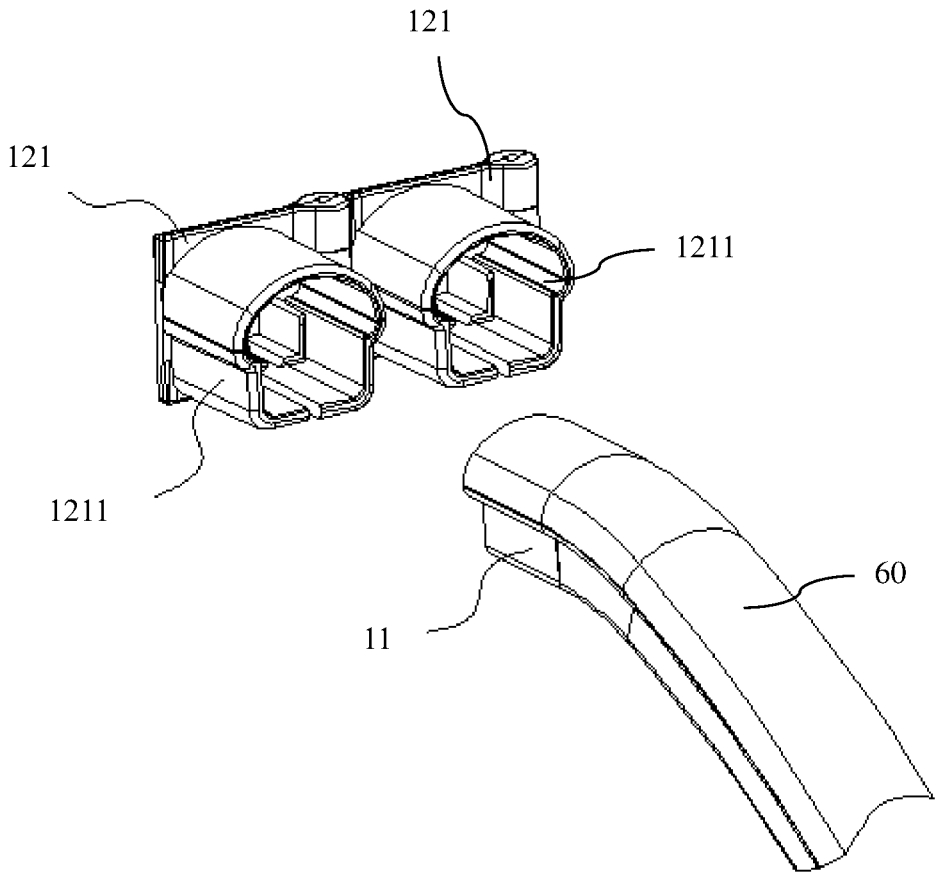
FIG. 5 illustrates a schematic drawing of the top pivot sheet and the rib stand of the first embodiment of the present invention.
Figure 6:
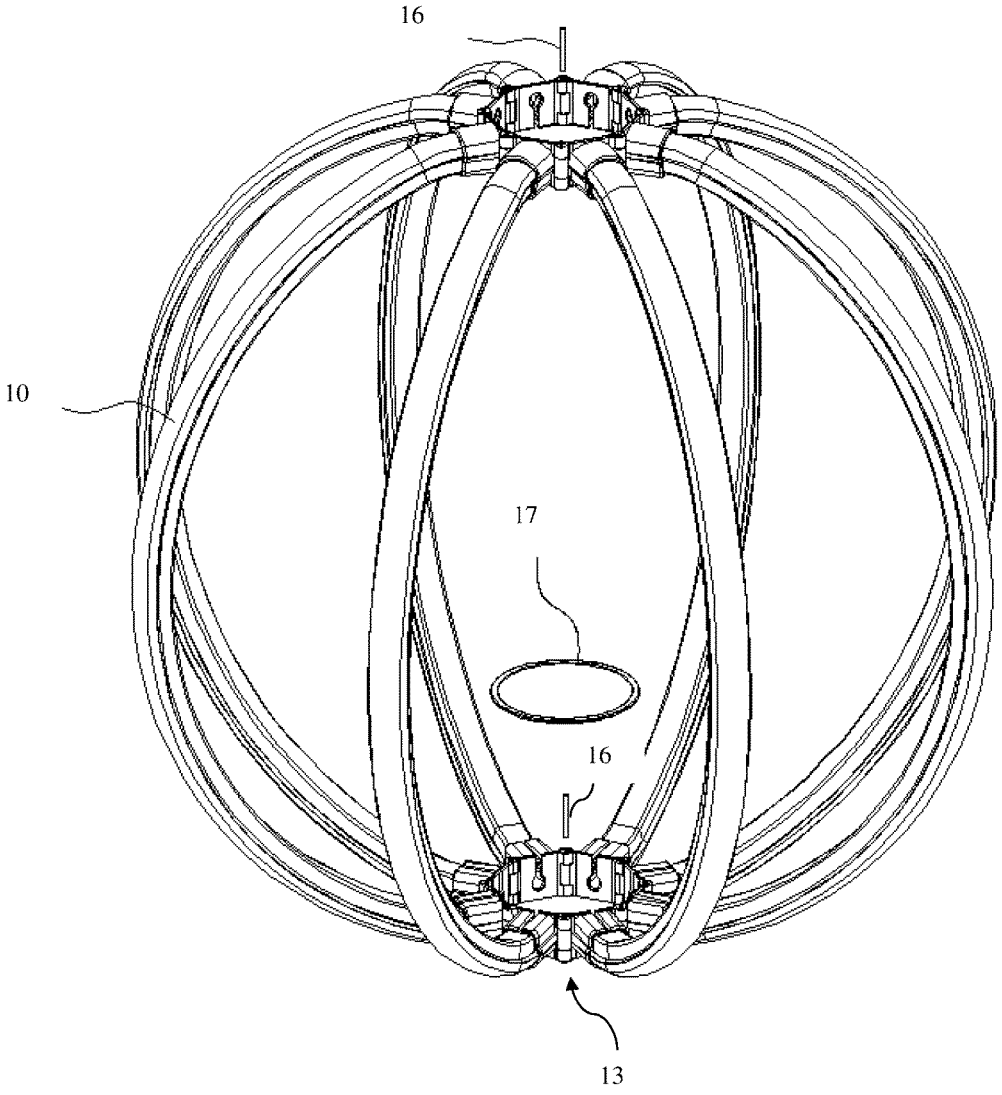
FIG. 6 illustrates a schematic drawing of another type of the collapsible decorative lamp in the first embodiment of the present invention in the opened state.
Figure 7:
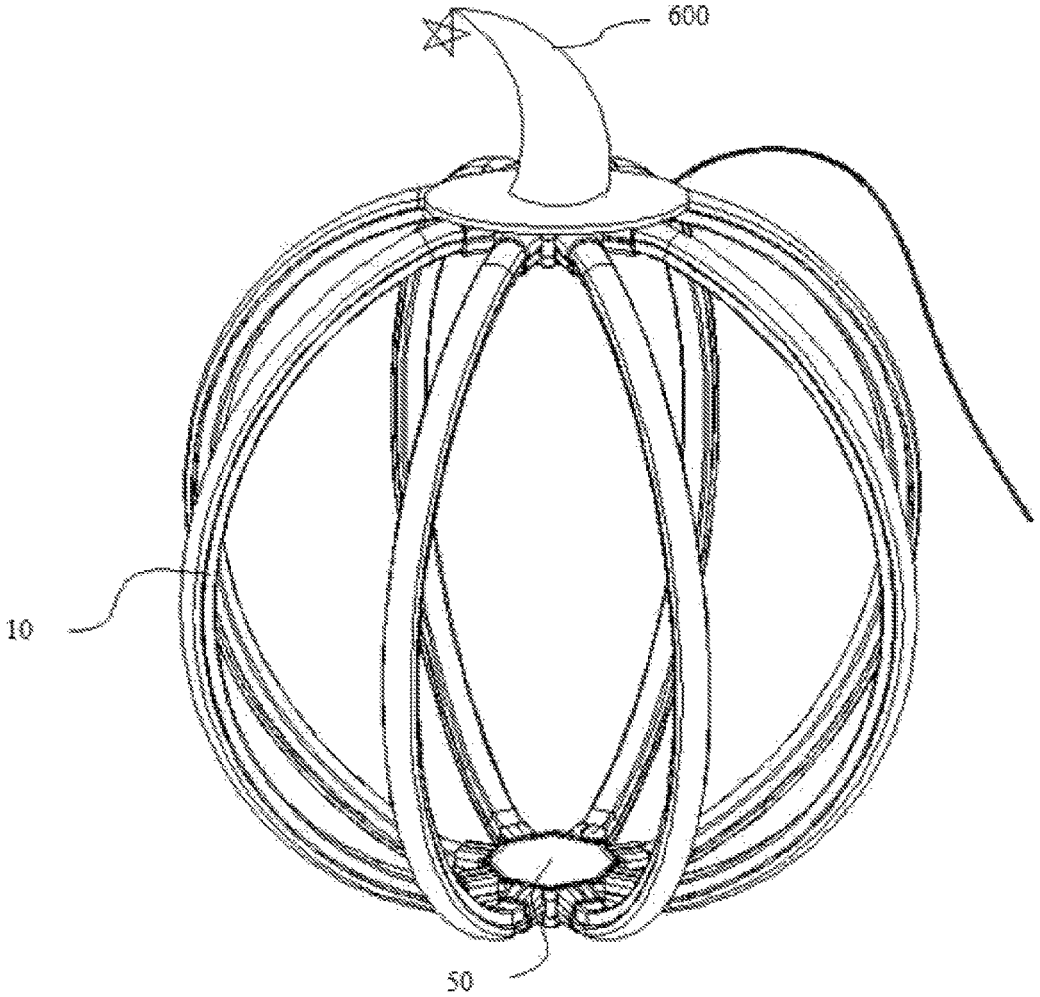
FIG. 7 illustrates a schematic drawing of the collapsible decorative lamp and the decorative unit in the first embodiment of the present invention.
Figure 8:
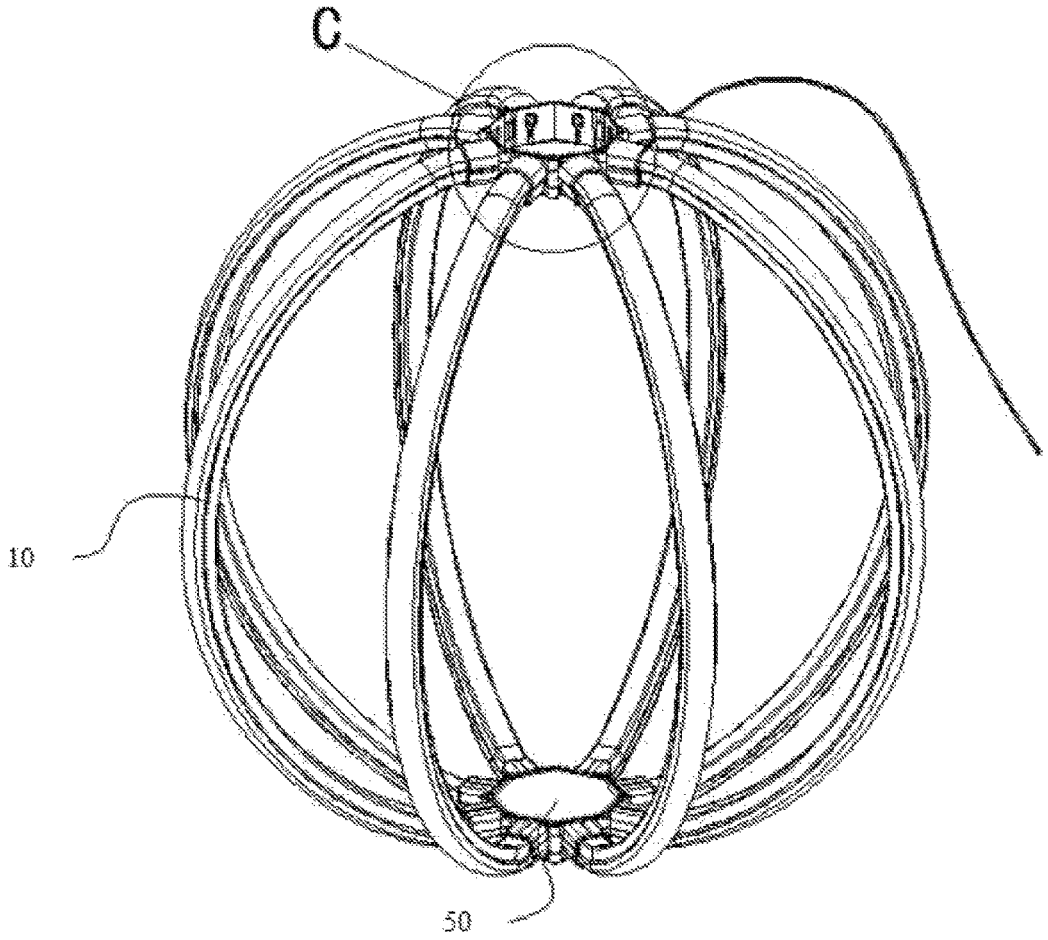
FIG. 8 illustrates a schematic drawing of another type of structure of the collapsible decorative lamp in the first embodiment of the present invention.
Figure 9:
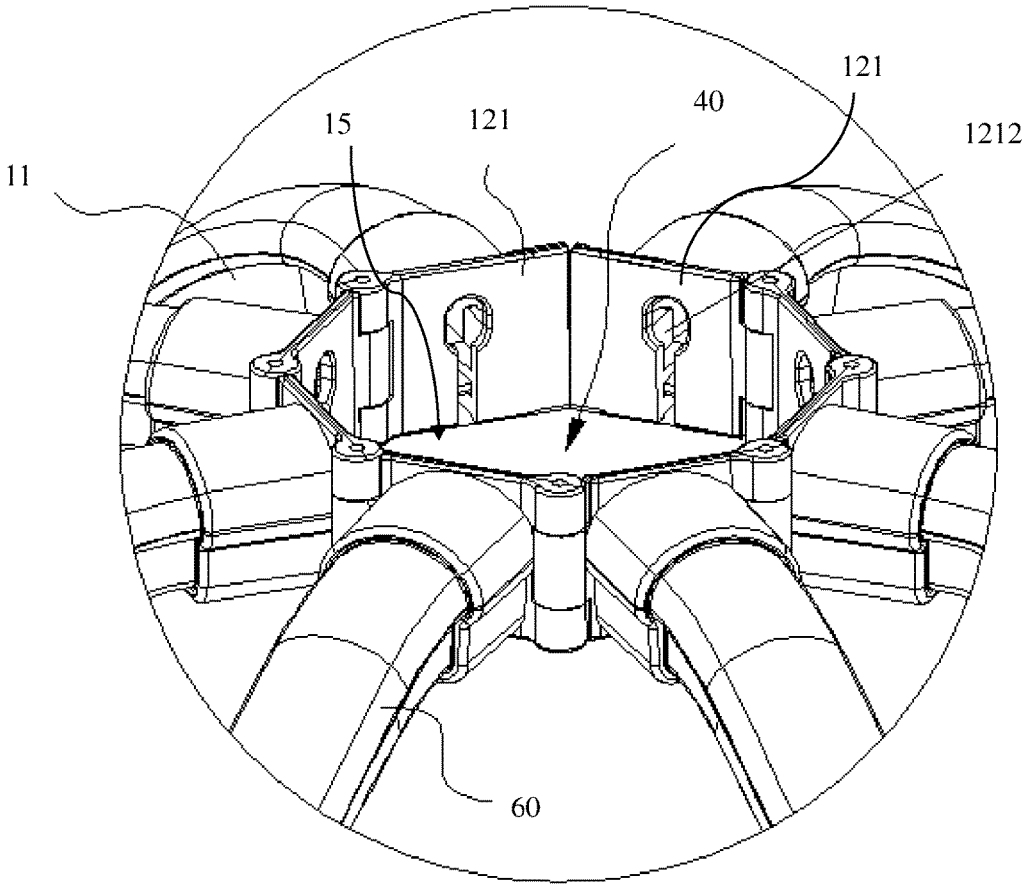
FIG. 9 illustrates a close-up drawing of the part indicated by C in FIG. 8.
Figure 10:
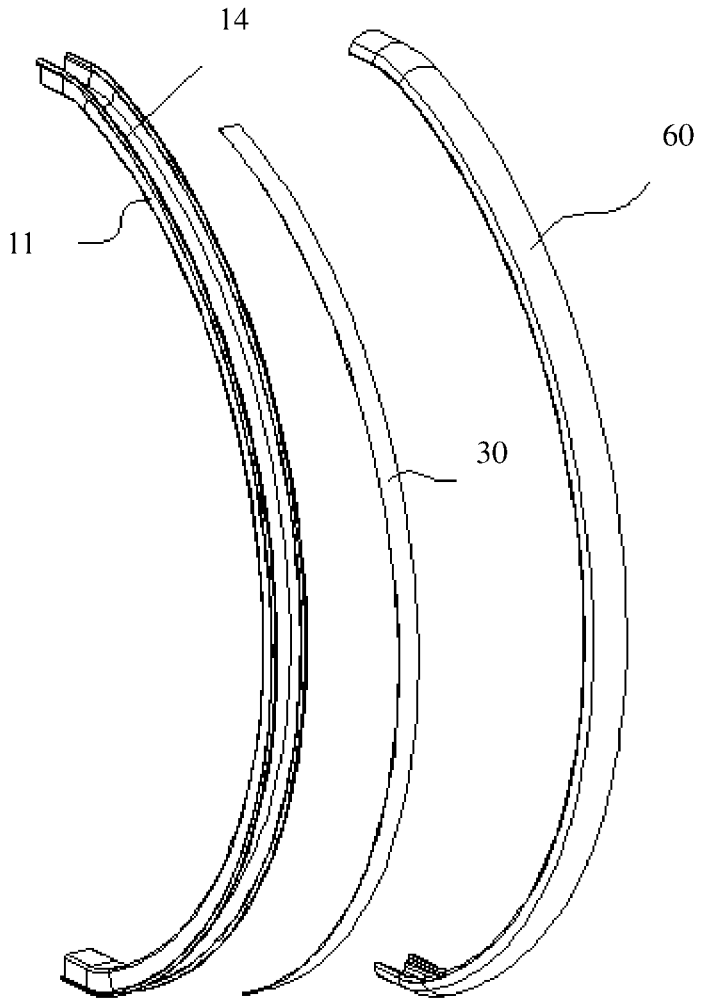
FIG. 10 illustrates a schematic drawing of the rib stand and the light strip in the first embodiment of the present invention.

Please refer to FIG. 1 to FIG. 10, which illustrate the collapsible decorative lamp in the first embodiment of the present invention. FIG. 1 illustrates a schematic drawing of a first embodiment of the collapsible decorative lamp of the present invention in the opened state. FIG. 2 illustrates a close-up drawing of the part indicated by A in FIG. 1. FIG. 3 illustrates a schematic drawing of the first embodiment of the collapsible decorative lamp of the present invention in the closed state. FIG. 4 illustrates a close-up drawing of the part indicated by B in FIG. 3. FIG. 5 illustrates a schematic drawing of the top pivot sheet and the rib stand of the first embodiment of the present invention. FIG. 6 illustrates a schematic drawing of another type of the collapsible decorative lamp in the first embodiment of the present invention in the opened state. FIG. 7 illustrates a schematic drawing of the collapsible decorative lamp and the decorative unit in the first embodiment of the present invention. FIG. 8 illustrates a schematic drawing of another type of structure of the collapsible decorative lamp in the first embodiment of the present invention. FIG. 9 illustrates a close-up drawing of the part indicated by C in FIG. 8. FIG. 10 illustrates a schematic drawing of the rib stand and the light strip in the first embodiment of the present invention.

In the first embodiment of the present invention, as shown in FIG. 1 to FIG. 5, the collapsible decorative lamp 1 is a lamp which can be collapsed to reduce the whole volume. The collapsible decorative lamp 1 includes a collapsible frame 10, a plurality of light strips 30, a top plate 40, a bottom plate 50, a plurality of translucent units 60 and a power unit 130.

The collapsible frame 10 is a frame which can be collapsed or expanded. The collapsible frame 10 is made of metal or plastic. The collapsible frame 10 includes a plurality of rib stands 11, a top folding band 12, a bottom folding band 13, a plurality of light slots 14, a plurality of plugs 16 and a supporting ring 17. Each of the plurality of rib stands 11 is shaped as a curved strip (such as a C-shaped structure with a semi-circular arc or a 3-segmented structure with angles), or each of the plurality of rib stands 11 can be shaped as a straight strip such that the opening collapsible frame 10 appears as a square. The top folding band 12 includes a plurality of top pivot sheets 121. The plurality of top pivot sheets 121 are respectively connected to one end (which is also the top end) of each of the plurality of rib stands 11. The plurality of top pivot sheets 121 are pivotally connected to one another. The plurality of top pivot sheets 121 are rotatable such that the top folding band 12 appears as a long strip structure (as shown in FIG. 3) or a ring structure (as shown in FIG. 1). Each of the top pivot sheets 121 includes a top fastener 1211 and a top pivot sheet hole 1212. Each of the top fasteners 1211 is fastened to one end of the rib stand 11 to ensure that the end of the rib stand 11 is combined with the top folding band 12 stably. However, the connecting method of the top pivot sheet 121 and the end of the rib stand 11 is not limited to that design; the top pivot sheet 121 and the end of the rib stand 11 can also be integrated. The top pivot sheet hole 1212 links to the light slot 14 such that the wire of the power unit 130 can enter the light slot 14.

The bottom folding band 13 includes a plurality of bottom pivot sheets 131. Each of the plurality of bottom pivot sheets 131 is respectively connected to another end (which is also the bottom end) of each of the plurality of rib stands 11. The plurality of bottom pivot sheets 131 are pivotally connected to one another. The plurality of bottom pivot sheets 131 are rotatable such that the bottom folding band 13 appears as a long strip structure (as shown in FIG. 3) or a ring structure (as shown in FIG. 1). Each of the bottom pivot sheets 131 includes a bottom fastener 1311. The bottom fastener 1311 is fastened to the other end of the rib stand 11 to ensure that the other end of the rib stand 11 is combined with the bottom folding band 13 stably. However, the connecting method of the bottom pivot sheet 131 and the other end of the rib stand 11 is not limited to that design; the bottom pivot sheet 131 and the other end of the rib stand 11 can also be integrated.

The plurality of light slots 14 are respectively located on the plurality of rib stands 11. The light slot 14 is used for containing the light strip 30. The plurality of plugs 16 are plugged between the pivotally connecting top pivot sheets 121 or the pivotally connecting bottom pivot sheets 131 such that the pivotally connecting relation of the top pivot sheets 121 or the bottom pivot sheets 131 is stable. The supporting ring 17 is located in the ring structure of the bottom folding band 13. The supporting ring 17 is used for supporting the ring structure of the bottom folding band 13 such that the ring structure is stable.

The plurality of light strips 30 are light emitting diode strips and are respectively located in the plurality of light slots 14. The plurality of translucent units 60 are translucent sheets which respectively cover the plurality of light strips 30 and seal the plurality of light slots 14 such that the light strips 30 are respectively in the light slots 14.

The top plate 40 is connected to one top pivot sheet 121 of the top folding band 12. When the top folding band 12 appears as the ring structure, the ring structure of the top folding band 12 surrounds the top plate 40, and the ring structure of the top folding band 12 and the top plate 40 form a top containing area 15. The top containing area 15 is used for containing the power unit 130. The top plate 40 includes a top plate hole 41, and the top plate hole 41 is a perforation with a screw thread. The bottom plate 50 is connected to one bottom pivot sheet 131 of the bottom folding band 13. When the bottom folding band 13 appears as the ring structure, the ring structure of the bottom folding band 13 surrounds the bottom plate 50. The thickness of the bottom plate 50 is substantially the same as the thickness of the bottom pivot sheet 131 to increase the weight of the bottom plate 50 such that the center of gravity of the whole structure is sufficiently low for the collapsible decorative lamp 1 to be placed on a surface stably as a decoration, and the structure of the rib stands 11 can be stable to prevent deformation. The cross-sectional shapes of the top plate 40 and the bottom plate 50 are the same. The cross-sectional shapes of the top plate 40 and the bottom plate 50 are both regular polygons, and the sides of the regular polygon are equal in number to the number of the rib stands 11; for example, in this embodiment, the cross-sectional shapes of the top plate 40 and the bottom plate 50 are both octagons, and the number of the rib stands 11 is eight. However, the cross-sectional shapes of the top plate 40 and the bottom plate 50 are not limited to that design; the cross-sectional shapes can be designed as other shapes (such as a circle).

The power unit 130 is a battery with a plurality of wires (not shown in the figure). The power unit 130 is located in the top containing area 15, and each of the wires of the power unit 130 respectively passes through the plurality of top pivot sheet holes 1212 to enter the light slots 14 to connect to the light strips 30 in the light slots 14 for providing power to the light strips 30.

As shown in FIG. 1 and FIG. 3, when the user wants to store the collapsible decorative lamp 1, the user can apply a force to the plurality of rib stands 11 of the collapsible frame 10 to cause the plurality of rib stands 11 to collapse both the top folding band 12 and the bottom folding band 13 such that the top folding band 12 appears as a long strip structure, the bottom folding band 13 appears as a long strip structure, and the plurality of rib stands 11 are close together. At this moment, the whole volume of the closing collapsible decorative lamp 1 is reduced. Therefore, the collapsible decorative lamp 1 can be stored, transported and packaged with a low cost.

Figure 11:
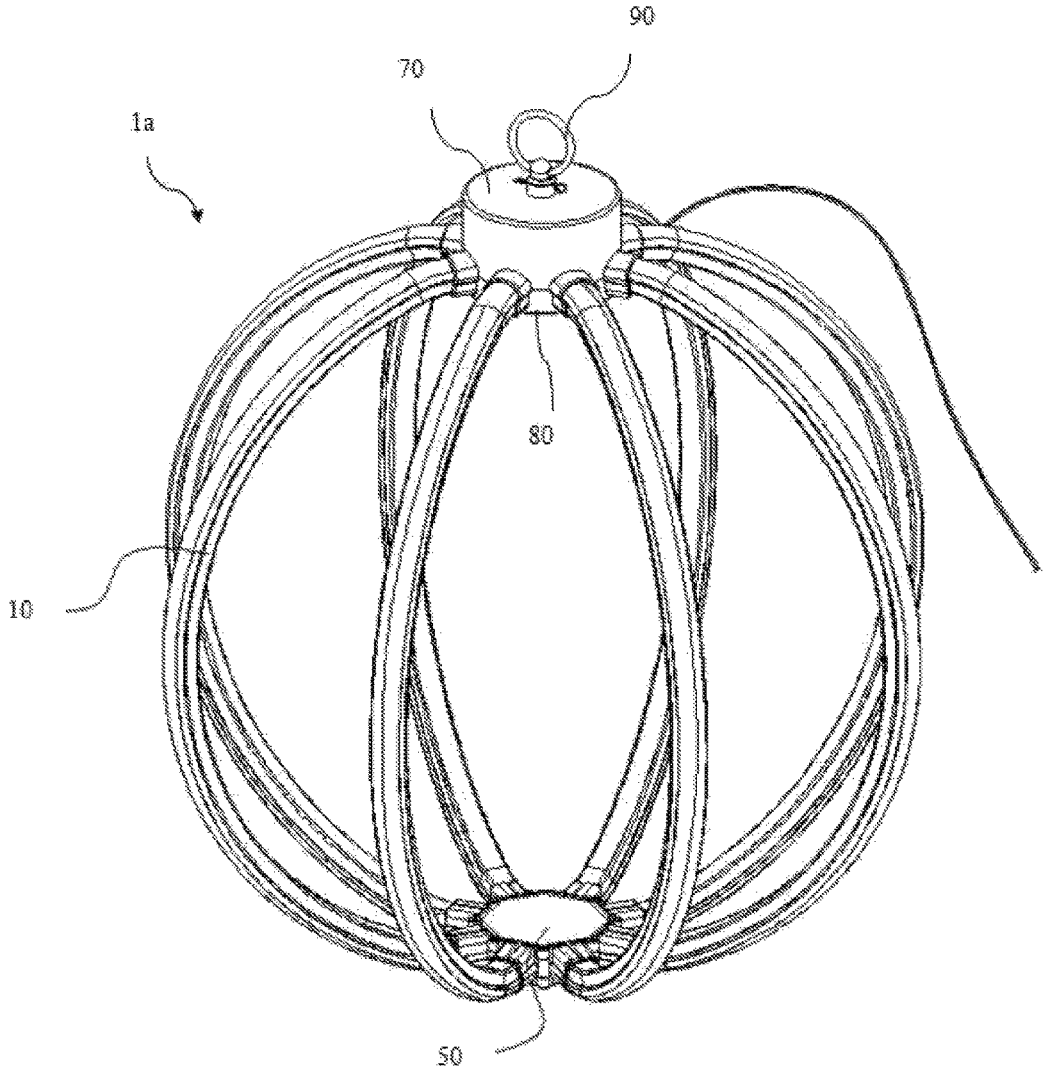
FIG. 11 illustrates a schematic drawing of the collapsible decorative lamp in a second embodiment of the present invention.
Figure 12:
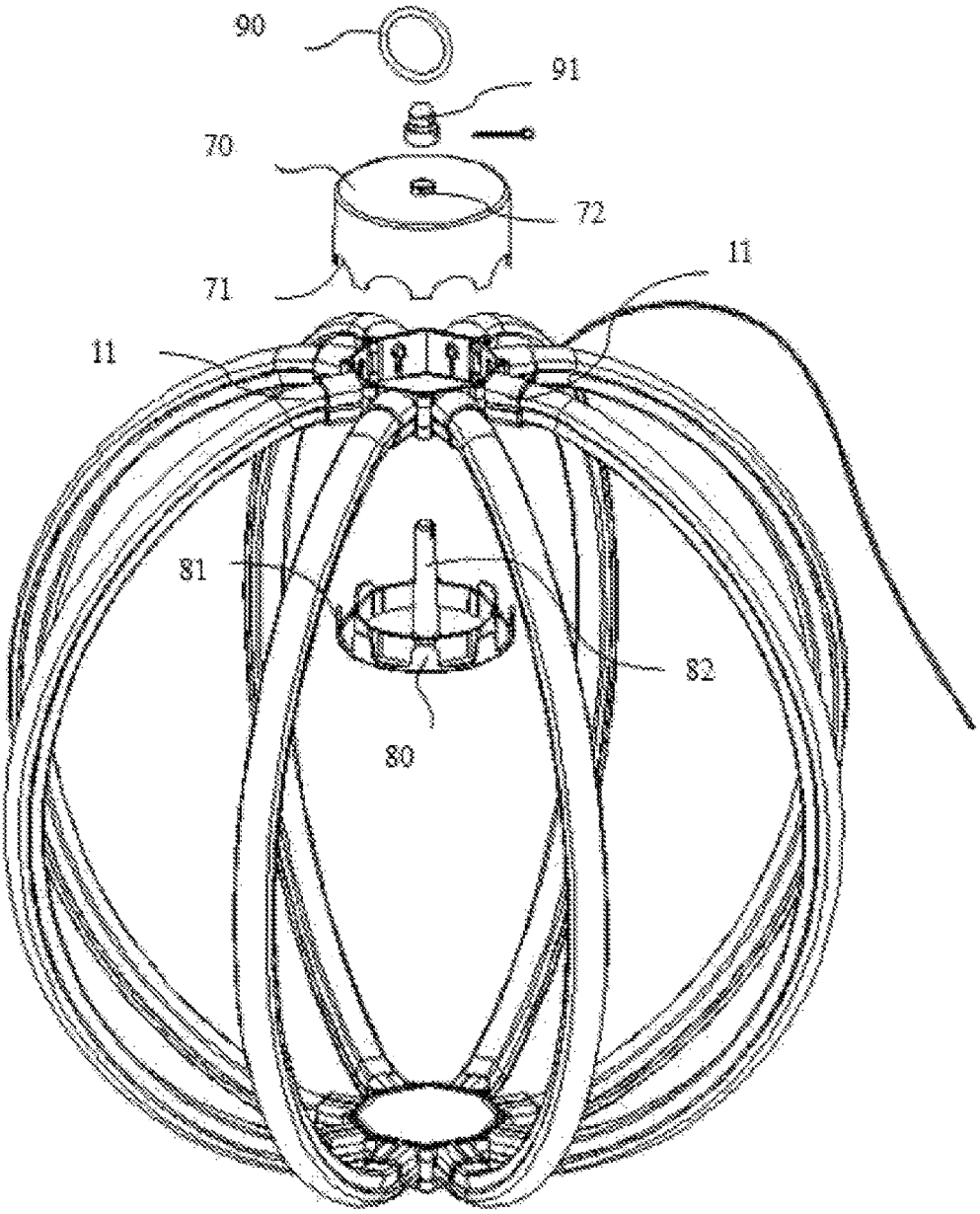
FIG. 12 illustrates a schematic drawing of the upper cover, the lower cover and the hanging ring of the second embodiment of the collapsible decorative lamp of the present invention.
Figure 13:
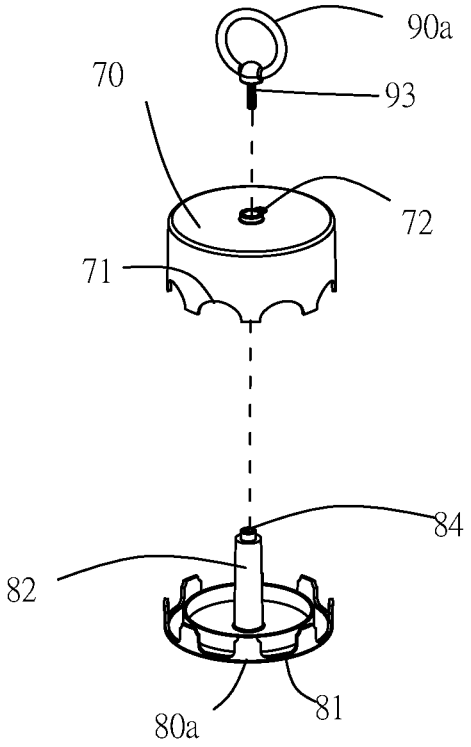
FIG. 13 illustrates a schematic drawing of another type of the upper cover, the lower cover and the hanging ring in the second embodiment of the present invention.

As shown in FIG. 1, FIG. 2 and FIG. 7, when the user wants to expand the collapsible decorative lamp 1, the user can apply a force to the plurality of rib stands 11 of the collapsible frame 10 to cause the plurality of rib stands 11 to expand the top folding band 12 and the bottom folding band 13 such that the top folding band 12 appears as a ring structure, the bottom folding band 13 appears as a ring structure, and the plurality of rib stands 11 are expanded to form a hollow spherical structure. When the top folding band 12 appears as the ring structure, the top folding band 12 surrounds the top plate 40. When the bottom folding band 13 appears as the ring structure, the bottom folding band 13 surrounds the bottom plate 50. When the collapsible decorative lamp 1 appears as the hollow spherical structure, the user can operate the power unit 130 to provide power to the light strips 30 to emit light. Thus, the collapsible decorative lamp 1 will appear as a lighting spherical structure with a beautiful and special visual effect. In addition, as shown in FIG. 7, the user can install an external decorative unit 600 on top of the collapsible frame 10 according to personal decoration requirements to enhance the decorative effect of the collapsible decorative lamp 1. Please refer to FIG. 11 to FIG. 13, which illustrate the collapsible decorative lamp in the second embodiment of the present invention. FIG. 11 illustrates a schematic drawing of the collapsible decorative lamp in a second embodiment of the present invention. FIG. 12 illustrates a schematic drawing of the upper cover, the lower cover and the hanging ring of the second embodiment of the collapsible decorative lamp of the present invention. FIG. 13 illustrates a schematic drawing of another type of the upper cover, the lower cover and the hanging ring in the second embodiment of the present invention.

As shown in FIG. 11 and FIG. 12, the difference between the second embodiment and the first embodiment is that, in the second embodiment, the collapsible decorative lamp 1*a* further includes an upper cover 70, a lower cover 80 and a hanging ring 90. The upper cover 70 includes a plurality of upper cover grooves 71 and an upper cover hole 72. The upper cover 70 is located above the ring structure of the top folding band 12. The lower cover 80 includes a plurality of lower cover grooves 81 and a column 82. The lower cover 80 is located under the ring structure of the top folding band 12. The upper cover 70, the lower cover 80 and the plurality of rib stands 11 are combined with one another. The hanging ring 90 includes a locking unit 91, and the locking unit 91 is used for combining with the column 82. When the upper cover 70, the lower cover 80 and the plurality of rib stand 11 are combined, the plurality of upper cover grooves 71, the plurality of lower cover grooves 81 and the plurality of rib stands 11 will be combined with one another, and the column 82 will pass through the upper cover hole 72 and the top plate hole to be exposed to the outside, whereby the exposed column 82 can be combined with the locking unit 92 to connect to the hanging ring 90 such that the user can use the hanging ring 90 to hang the collapsible decorative lamp 1*a* from the ceiling. The shapes of the combining upper cover grooves 71, the lower cover grooves 81 and the rib stands 11 are coordinated with one another to provide a supporting force for the collapsible decorative lamp 1*a* such that the structure of the rib stands 11 is stable to prevent deformation. It is to be known that, because the combination of the upper cover 70 and the lower cover 80 is very stable, the upper cover 70 and the lower cover 80 can be fastened to each of the rib stands 11. Therefore, the pivot sheets of the top folding band 12 can be designed to be separated, and the opened rib stands 11 are fixed only via the upper cover 70 and the lower cover 80.

However, as shown in FIG. 13, the combination method of the upper cover, the lower cover and the hanging ring is not limited to the abovementioned description. For example, the lower cover 80*a* further includes a screw hole 84, and the screw hole 84 is located above the column 82. The hanging ring 90*a* further includes a screw column 93, and hanging ring 90*a* does not include the locking unit 91. When the upper cover 70 and the lower cover 80*a* are combined, the column 82 will pass through the upper cover hole 72 and the screw hole 84 to be exposed to the outside, whereby the exposing screw hole 84 can be combined with the screw column 93; thus, the upper cover 70, the lower cover 80*a* and the hanging ring 90*a* can be combined stably. Furthermore, the user may choose not to use the lower cover 80*a*, and the user can choose to use only the screw column 93 of the hanging ring 90*a* to pass through the upper cover hole 72 and directly fasten the screw column 93 to the perforation with a screw thread of the top plate hole. Therefore, the top plate, the upper cover 70 and the hanging ring 90*a* can be combined stably, and the upper cover 70 can also fasten the plurality of rib stands 11 stably.

Figure 14:
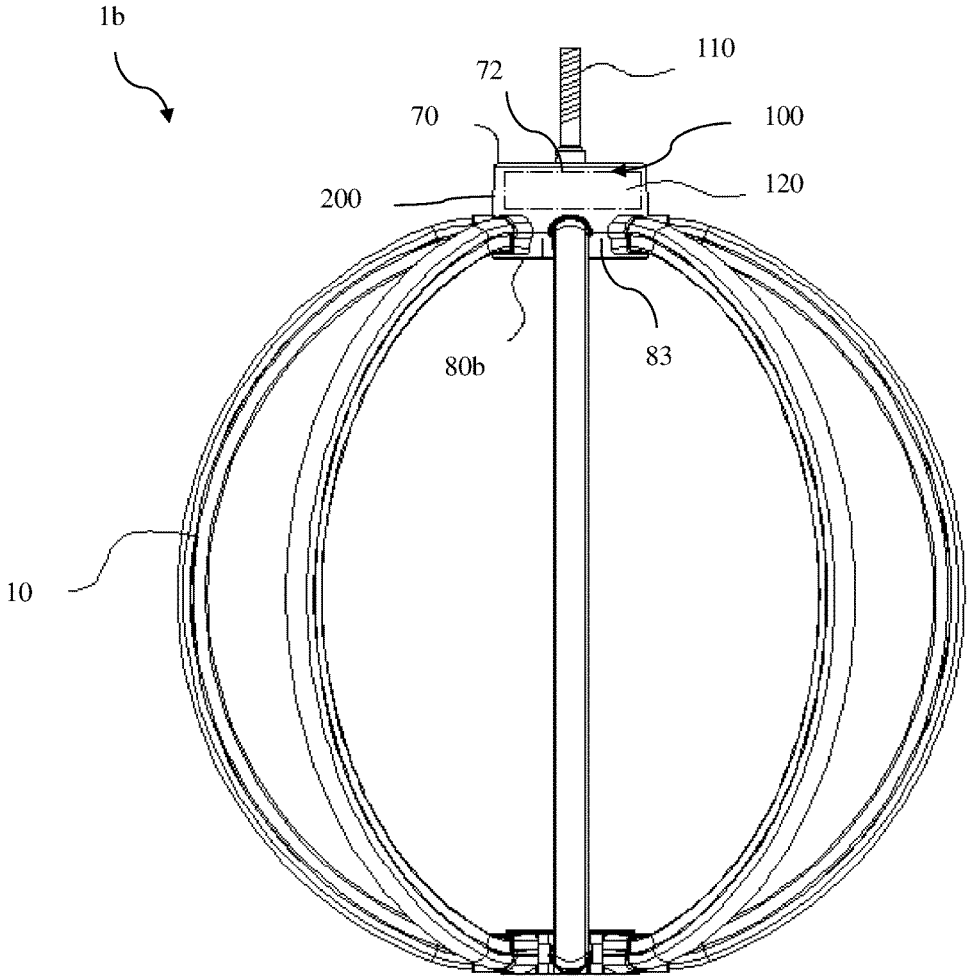
FIG. 14 illustrates a schematic drawing of the collapsible decorative lamp in a third embodiment of the present invention.

Please refer to FIG. 14, which illustrates the collapsible decorative lamp in the third embodiment of the present invention. FIG. 14 illustrates a schematic drawing of the third embodiment of the collapsible decorative lamp of the present invention.

As shown in FIG. 14, the difference between the third embodiment and the second embodiment is that, in the third embodiment, the collapsible decorative lamp 1*b* further includes a motor system 100, and the motor system 100 includes a shaft 110 and a rotating motor 120. The lower cover 80*b* does not include the column 82, and the lower cover 80*a* further includes a lower cover hole 83. The position of the top plate hole, the position of the upper cover hole 72 and the position of the lower cover hole 83 are corresponded to one another. A containing space 200 is formed between the upper cover 70 and the lower cover 80*b*. The rotating motor 120 is located in the containing space 200. The shaft 110 passes through the upper cover hole 72 and the top plate hole to be exposed to the outside. The shaft 110 is used for connecting to an external ceiling. The rotating motor 120 is used for causing the shaft 110 to rotate such that the collapsible decorative lamp 1*b* rotates. Therefore, the collapsible decorative lamp 1*b* which is hung on the ceiling via the shaft 110 can emit light and rotate to provide a decorative effect.

Figure 15:
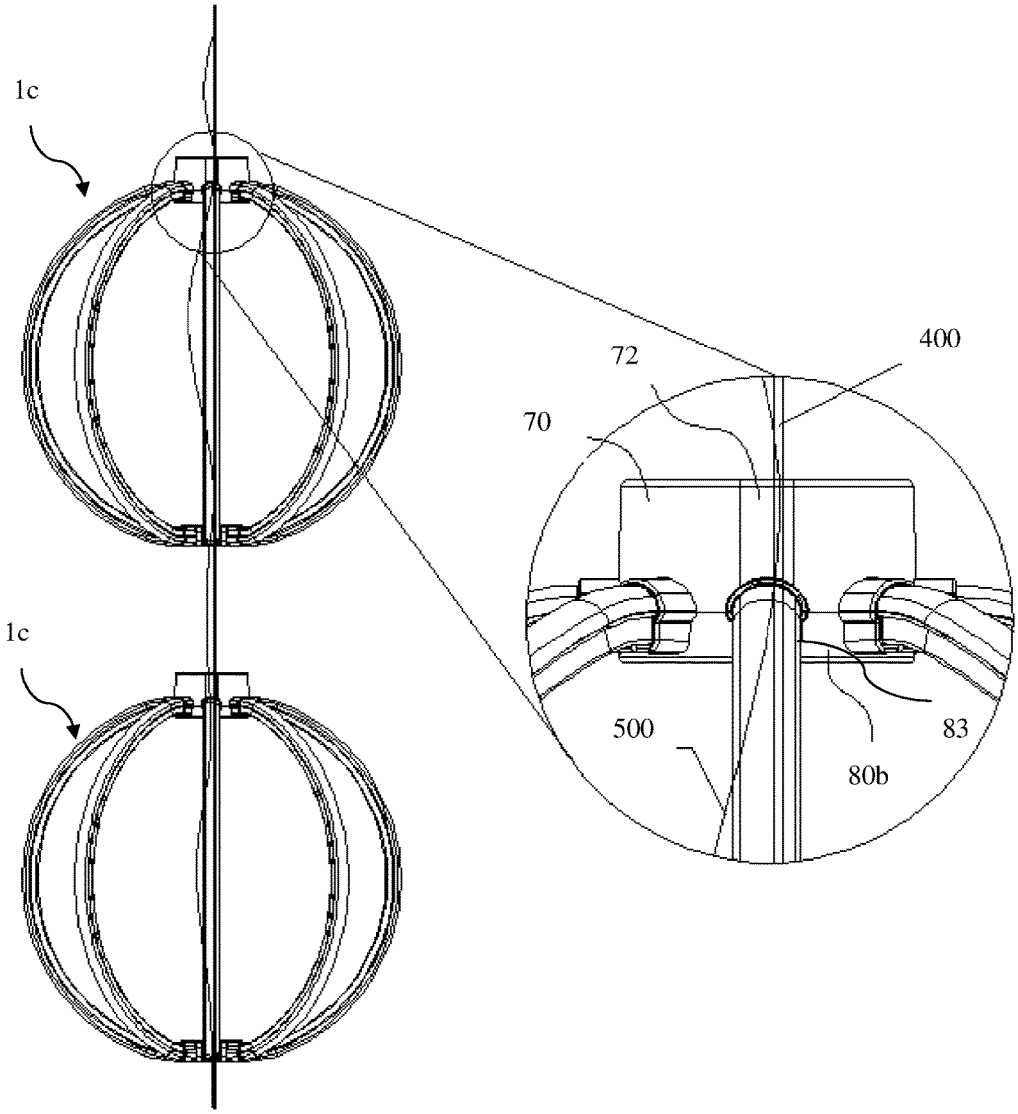
FIG. 15 illustrates a schematic drawing of the collapsible decorative lamp in a fourth embodiment of the present invention.

Please refer to FIG. 15, which illustrates the collapsible decorative lamp in the fourth embodiment of the present invention. FIG. 15 illustrates a schematic drawing of the collapsible decorative lamp in a fourth embodiment of the present invention.

As shown in FIG. 15, the difference between the fourth embodiment and the third embodiment is that, in the fourth embodiment, the user can use the external sling 400 and wire 500 such that they pass through the top plate hole, the upper cover hole 72 and the lower cover hole 83 of each of the collapsible decorative lamps 1*c* such that the collapsible decorative lamps 1*c* can be hung from a ceiling to provide a special visual effect.

Via the structure of the collapsible decorative lamp of the present invention, the collapsible decorative lamp can be opened to appear as a three-dimensional lamp to provide a beautiful visual effect, and the collapsible decorative lamp can work with an external decoration or sling to be hung from a ceiling. The collapsible decorative lamp can also be closed to reduce the volume and thereby to reduce the costs of product storage, transport and packing.

In summary, regardless of the purposes, means and effectiveness, this invention is quite different from the known technology and should merit the issuing of a new patent. However, it is noted that many of the above-mentioned embodiments are only for illustrative purposes; the claims of the invention should depend on the claims and not be limited to the embodiments.

What is claimed is:

1. A collapsible decorative lamp, comprising:

a collapsible frame, comprising:

a plurality of rib stands, wherein each of the plurality of rib stands is shaped as a curved strip;

a top folding band, comprising a plurality of top pivot sheets, wherein the plurality of top pivot sheets are respectively connected to one end of each of the plurality of rib stands, the plurality of top pivot sheets are pivotally connected to one another, and the plurality of top pivot sheets are rotatable such that the top folding band appears as a long strip structure or a ring structure;

a bottom folding band, comprising a plurality of bottom pivot sheets, wherein the plurality of bottom pivot sheets are respectively connected to the other end of each of the plurality of rib stands, the plurality of bottom pivot sheets are pivotally connected to one another, and the plurality of bottom pivot sheets are rotatable such that the bottom folding band appears as a long strip structure or a ring structure; and a plurality of light slots, respectively located on the plurality of rib stands;

a plurality of light strips, respectively located on the plurality of light slots; and a top plate, connected to one of the top pivot sheets of the top folding band;

wherein when the top folding band appears as the long strip structure and the bottom folding band appears as the long strip structure, the plurality of rib stands are close to one another; when the top folding band appears as the ring structure and the bottom folding band appears as the ring structure, the plurality of rib stands are away from one another, and the ring structure of the top folding band surrounds the top plate.

2. The collapsible decorative lamp as claimed in claim 1, further comprising a bottom plate, wherein the bottom plate is connected to one of the bottom pivot sheets of the bottom folding band; when the bottom folding band appears as the ring structure, the ring structure of the bottom folding band surrounds the bottom plate.

3. The collapsible decorative lamp as claimed in claim 2, further comprising a plurality of translucent units, wherein the plurality of translucent units respectively cover the plurality of light strips.

4. The collapsible decorative lamp as claimed in claim 3, wherein the top pivot sheet further comprises a top pivot sheet hole, and the top pivot sheet hole links to the light slot.

5. The collapsible decorative lamp as claimed in claim 4, wherein when the ring structure of the top folding band surrounds the top plate, the top folding band and the top plate form a top containing area, and the top containing area is used for containing a power unit.

6. The collapsible decorative lamp as claimed in claim 5, further comprising an upper cover and a lower cover; the upper cover is located above the ring structure of the top folding band, and the lower cover is located under the ring structure of the top folding band.

7. The collapsible decorative lamp as claimed in claim 6, wherein the upper cover comprises a plurality of upper cover grooves, and the lower cover comprises a plurality of lower cover grooves; the plurality of upper cover grooves, the plurality of lower cover grooves and the plurality of rib stands are combined with one another.

8. The collapsible decorative lamp as claimed in claim 7, further comprising a hanging ring, wherein the top plate further comprises a top plate hole, the upper cover further comprises an upper cover hole, and the lower cover further comprises a column; the column passes through the upper cover hole and the top plate hole, and the column is connected to the hanging ring.

9. The collapsible decorative lamp as claimed in claim 7, wherein the top plate further comprises a top plate hole, the upper cover further comprises an upper cover hole, and the lower cover further comprises a lower cover hole; a position of the top plate hole, a position of the upper cover hole and a position of the lower cover hole are corresponded to one another.

10. The collapsible decorative lamp as claimed in claim 7, further comprising a motor system, wherein the motor system comprises a shaft and a rotating motor; a containing space is formed between the upper cover and the lower cover, the rotating motor is located in the containing space, and the shaft passes through the upper cover hole and the top plate hole.

11. The collapsible decorative lamp as claimed in claim 7, wherein each of the plurality of top pivot sheets further comprises a top fastener, and the top fastener is fastened to the end of the rib stand; each of the plurality of bottom pivot sheets further comprises a bottom fastener, and the bottom fastener is fastened to the other end of the rib stand.

12. The collapsible decorative lamp as claimed in claim 7, wherein the top pivot sheet and the end of the rib stand are integrated, and the bottom pivot sheet and the other end of the rib stand are integrated.

* * * * *